United States Patent [19]

Weeks

[11] Patent Number: 4,770,333

[45] Date of Patent: Sep. 13, 1988

[54] GUARD FOR A PRESS MACHINE

[75] Inventor: Victor Weeks, Morden, England

[73] Assignee: James Burn International Limited, Great Britain

[21] Appl. No.: 40,932

[22] Filed: Apr. 21, 1987

[30] Foreign Application Priority Data

Apr. 28, 1986 [GB] United Kingdom ..... 8610384

[51] Int. Cl.[4] ..... B21J 15/28

[52] U.S. Cl. ..... 227/8

[58] Field of Search ..... 227/8

[56] References Cited

U.S. PATENT DOCUMENTS 4,343,423 8/1982 Sovermitch ..... 227/8 X
4,378,900 4/1983 Sovermitch ..... 227/8
4,485,541 12/1984 Seki ..... 227/8 X
4,676,421 6/1987 Swanstrom ..... 227/8

*Primary Examiner*—Paul A. Bell
*Attorney, Agent, or Firm*—Wood, Herron & Evans

[57] ABSTRACT

A press machine for articles to be pressed has a "movable" jaw (2) which acts upon said articles, protective guard means (8) for the moveable jaw, and operation control means (16), one part (24) of which is attached to the guard means and another part (20) of which is attached to the moveable jaw, the control means permitting operation of the moveable jaw only when the part of the control means attached to the guard means, mates with that part of the control means attached to the moveable jaw.

9 Claims, 1 Drawing Sheet

GUARD FOR A PRESS MACHINE

BACKGROUND OF THE INVENTION

This invention relates to the guarding of machines such as "presses". One type of press which is intended to act on and thus to close binding elements for packets of paper, is a jaw which is moveable relative to a second jaw or surface to close a binding element through perforations in a packet of paper to bind the sheets of paper together. A machine of this type is described in British Patent No. 2083408.

With such a press the stroke of the moveable jaw has to be variable so as to accommodate different thicknesses of packets of paper and different thicknesses of binding elements.

As the packets of paper are fed manually between the jaw and co-operating surface/jaw, a guard needs to be provided to prevent a user's fingers from being trapped between the jaw and co-operating surface.

Hitherto a guard plate has been provided which is intended partially to cover the opening between the jaw and co-operating jaw or surface and which may be manually adjustable when the stroke of the moveable jaw is adjusted.

If for example a relatively large opening between the jaw/co-operating surface is to be provided to admit a relatively thick packet to be bound then the position of the moveable jaw is adjusted upwardly and the guard is positioned in an upper position. When in this position a user's fingers may be able to enter the space between jaw/co-operating surface but would not be crushed because the end of the stroke of the moveable jaw is well above the base plate.

If however the guard is left in this position and the position of the moveable jaw is lowered so as to be able to act on the binding elements of a thinner packet of sheets, then there is a danger that a user's fingers could indeed be trapped when the machine is operated pneumatically by for example the operation of a foot pedal or the like.

SUMMARY OF THE INVENTION

In accordance with the invention, a press machine for articles to be pressed has a "moveable" jaw which acts upon said articles, protective guard means for the moveable jaw, and operation control means, one part of which is attached to the guard means and another part of which is attached to the moveable jaw, the control means permitting operation of the moveable jaw only when the part of the control means attached to the guard means, mates with that part of the control means attached to the movable jaw.

Suitably, the machine operates on receipt of a pneumatic signal, and has in its pneumatic circuit, between the operating member and a switch or the like for the machine drive.

Such ensures that the guard is always correctly positioned before the machine may be operated.

Preferably the moveable jaw is adjustably connected to a fixed stroke driving member. When the position between the driving member and the moveable jaw is adjusted so as to vary the position of the jaw from its fixed co-operating plate/jaw, the position of the other part of the control means which is connected to the moveable jaw is also altered relative to the part of the control means attached to the guard means.

DETAILED DESCRIPTION OF THE PREFERRED EMBODIMENT

Figure 2:
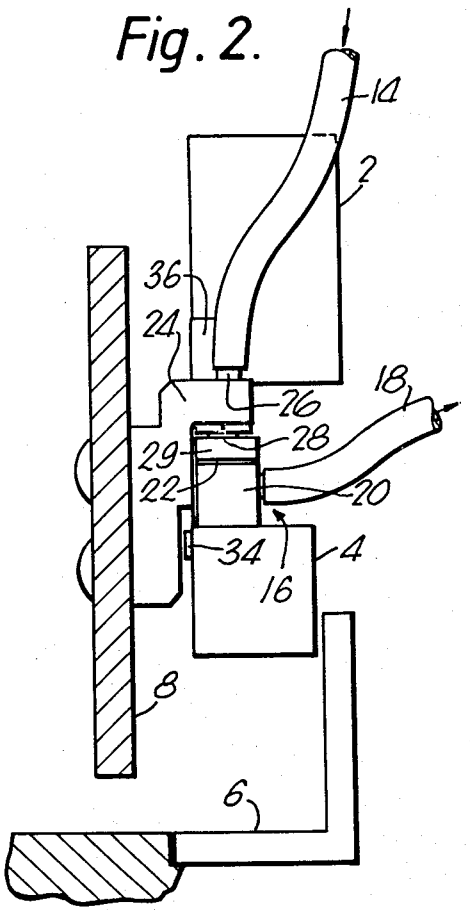
FIG. 2 is a side elevation of the press shown in FIG. 1.

The press is basically that described in British Patent No. 2083408, and includes a beam 2 having a fixed stroke, and a moveable 'jaw' 4 which in use is driven towards the base plate 6 of the machine.

A perspex guard plate 8 is provided to cover the gap between the moveable jaw 4 and the top surface of the plate 6, and the position of this guard plate is adjustable by moving it up and down within a slot 10 sliding over a pin 12, the pin 12 being manually tightened to hold the guard plate in any adjusted position relative to the plate 6.

The gap A between the upper face of the moveable jaw 4 and the driving beam 2 is adjusted by means, not shown. As the beam 2 has a fixed stroke, the adjustment alters the distance B, namely the gap between the lower face of the movable jaw 4 and the fixed surface of the plate 6, to accommodate differing thicknesses of packets of paper and their binding elements.

The beam 2 is driven downwardly on operation of a foot pedal (not shown) which transmits a pneumatic signal through a pipe 14 to operation control means in the form of a connector (generally indicated at 16) and thereafter to a further pneumatic pipe 18 the signal from which, operates a pneumatic switch to drive the beam.

The connector 16 comprises a plunger 20 having a passage therethrough (not shown), one end of which is connected to the air pipe 18 and the other end of which is open at the top surface 22 of the plunger. The other portion of the connector 16 comprises a block 24 attached to the guard plate 8, as can clearly be seen in FIG. 2. This block 24 has a passage through it connecting at one end 26 with the air pipe 14 and open at its other end at its face 28 with a hole to match the hole in the top surface 22 of the plunger. The plunger 20 carries a washer 29 so that when the mating faces of the plunger and connector part 24 are brought together via the washer 29, the passages through the two parts of the connector mate in an air-tight fashion enabling a pressure signal transmitted through the air pipe 14 to be transmitted to the air pipe 18.

When the distance A between the moveable jaw 4 and the operating beam 2 is increased so as to lower the moveable jaw towards the base plate 6, then the position of the plunger 20 will be lowered due to its engagement with one end 30 of a crank 32 which is pivotted at 34 to the movable jaw and which has its other end 36 engaged in a slot 38 in the moveable beam. When the plunger 20 is lowered, there will be no connection made by the connector 16 between the pipes 14 and 18, and hence the machine will not operate as and until the guard plate 8 is lowered so that the face 28 of the connector part 24 is again brought into operative connection with the top surface 22 of the plunger 20 via the washer 29. This ensures that the guard plate is always correctly positioned before the machine may be operated. If the guard plate is removed or not adjusted correctly, the machine will not operate. The guard only has to be displaced very slightly to prevent the connection from being made and hence the machine not being operable.

Figure 1:
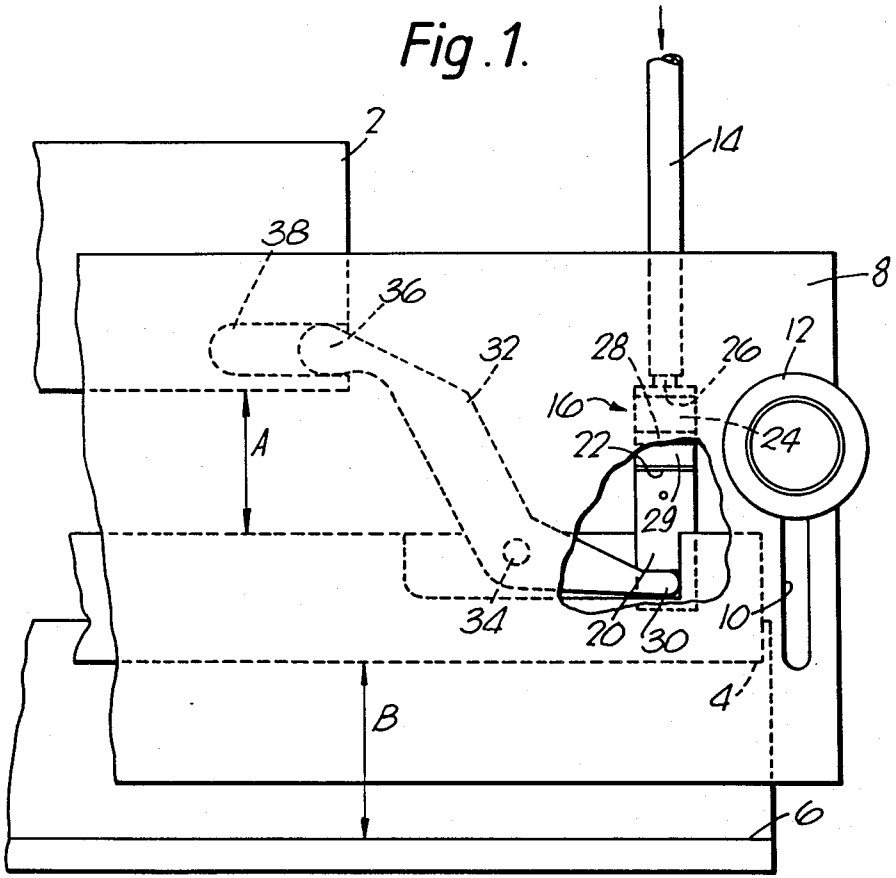
FIG. 1 is a schematic diagrammatic front view of a portion of one embodiment of a press in accordance with the invention.

The safety device shown in FIGS. 1 and 2 may be used with other machines requiring the accurate positioning of a guard depending on adjustments to the machine and which are operated by a pneumatic signal.

What I claim is:

1. A press machine which is operated by a pneumatic circuit, said machine comprising a movable jaw which is moved pneumatically between press and release positions as controlled by said pneumatic circuit, a protective guard fixed to said moveable jaw, and a connector interposed in said pneumatic circuit, a first part of said connector being attached to said guard and a second part of said connector being attached to said moveable jaw, said connector permitting operation of said moveable jaw only when said first part mates with said second part, said machine thereby being made operational only when said guard is correctly positioned relative to said jaw to permit completion of said penumatic circuit through said first and second parts.

2. A machine as claimed in claim 1 which has drive means for said jaw.

3. A machine as claimed in claim 2 which has a pneumatic circuit that operates, on receipt of a pneumatic signal, a switch for said drive means.

4. A machine as claimed in claim 1 wherein said part of said control means attached to said guard means has an upper surface which mates via a washer with a lower surface on said part of said control means attached to said jaw.

5. A machine as claimed in claim 4 wherein said upper surface is provided with a hole, wherein said lower surface is also provided with a hole, and wherein a pneumatic signal passes through these holes when such mate together.

6. A machine as claimed in claim 1 wherein said jaw is adjustably connected to a fixed stroke driving member.

7. A machine as claimed in claim 6 wherein a fixed jaw is provided to co-operate with said moveable jaw, and wherein the distance between said driving member and said moveable jaw is adjusted so as to vary the distance of said moveable jaw from said co-operating fixed jaw, the distance of said part of said control means attached to said moveable jaw being also altered relative to said part of said control means attached to said guard means.

8. A machine as claimed in claim 1 wherein said guide means is adjustably connected.

9. A machine as claimed in claim 8 wherein a fixed surface is provided to co-operate with said guard means, and wherein the distance between said guard means and said co-operating fixed surface is adjusted, the distance of said part of said control means attached to said guard means being also altered relative to said part of said control means attached to said jaw.

* * * * *